United States Patent [19]

Emberson et al.

[11] Patent Number: 4,743,797

[45] Date of Patent: May 10, 1988

[54] FLAT CATHODE RAY DISPLAY TUBES WITH INTEGRAL GETTER MEANS

[75] Inventors: David L. Emberson; Adrian Caple, both of Purley, England

[73] Assignee: U.S. Philips Corporation, New York, N.Y.

[21] Appl. No.: 904,438

[22] Filed: Sep. 8, 1986

[30] Foreign Application Priority Data

Sep. 11, 1985 [GB] United Kingdom ..... 8522542

[51] Int. Cl.[4] ..... H01J 29/94; H01J 31/12

[52] U.S. Cl. ..... 313/422; 313/103 CM; 313/105 CM; 313/553; 313/554; 313/558; 313/560; 313/477 R; 313/481; 313/634; 417/48; 417/51

[58] Field of Search ..... 313/422, 481, 560, 634, 313/106, 107, 103, 103 CM, 105, 105 CM, 558, 556, 553, 562, 482, 477 R, 479; 417/48, 49, 50, 51

[56] References Cited

U.S. PATENT DOCUMENTS

| | | | |
|---|---|---|---|
| 2,668,253 | 2/1954 | Taylor | 313/481 |
| 3,560,788 | 2/1971 | Reash et al. | 313/481 |
| 4,128,782 | 12/1978 | Fransen et al. | 313/481 |
| 4,608,518 | 8/1986 | Fukuda et al. | 313/481 |
| 4,642,516 | 2/1987 | Ward et al. | 313/481 |

FOREIGN PATENT DOCUMENTS

| | | | |
|---|---|---|---|
| 2098795 | 11/1982 | United Kingdom | 313/481 |
| 2101396 | 1/1983 | United Kingdom | 313/422 |

*Primary Examiner*—David K. Moore
*Assistant Examiner*—Michael J. Nickerson
*Attorney, Agent, or Firm*—John C. Fox

[57] ABSTRACT

In a flat cathode ray display tube having an electron gun adjacent a rear wall of the tube's envelope which produces an electron beam travelling across the rear wall before being turned in the opposite direction and then deflected onto a screen carried by faceplate opposite the rear wall, getter means is situated in one or more recesses, each defined at least in part by an elongate rib formed in the rear wall, e.g. by pressing, with the recess wall shielding the getter means directly from the gun to prevent contamination. The rib serves also to strengthen the rear wall. A line scanning deflector is similarly shielded.

7 Claims, 3 Drawing Sheets

FLAT CATHODE RAY DISPLAY TUBES WITH INTEGRAL GETTER MEANS

BACKGROUND OF THE INVENTION

This invention relates to a flat cathode ray display tube comprising an envelope having a front wall comprising a flat, optically transparent faceplate carrying a screen and a rear wall opposite the front wall, means for producing an electron beam disposed adjacent the rear wall, the electron beam producing means being arranged to direct an electron beam substantially parallel to the faceplate and over the rear wall of the envelope, a reversing lens which turns the electron beam so that it travels in the opposite direction parallel to the faceplate, a deflector arrangement for deflecting the turned beam towards the screen, and getter means located in the envelope.

A flat display tube generally of this kind is described in published British Patent Application No. 2101396A corresponding to U.S. patent application Ser. No. 830,388, filed Feb. 14, 1986 (PHB32794). In this tube, the envelope volume is divided into front and rear portions by a partition extending parallel to the faceplate, the electron beam being directed initially parallel to and over one side of the partition and then reversed by the reversing lens to travel parallel to the other side of the partition, this other side carrying a beam deflection electrode arrangement for field scanning. The tube also includes a further beam deflection electrode arrangement adjacent the electron beam producing means, namely an electron gun, in the rear envelope portion which serves to deflect the beam in a plane parallel to the partition and the faceplate to achieve line scanning, and a channel plate electron multiplier disposed closely adjacent and parallel to the screen for current multiplying the electron beam following deflection by the deflection electrode arrangements.

As is customary with cathode ray display tubes, getter means are contained within the envelope, although such means are not specifically referred to in the aforementioned published British Patent Application No. 2101396A. It is an important consideration in the locating of the getter means that upon activation thereof sensitive operating components within the envelope are not contaminated by material emanating from the getter means. Heretofore, the getter means has been disposed in the region of the electron gun. In order to prevent the electron gun from becoming contaminated by material from the getter means upon its activation, such contamination being likely to impair performance of the gun, a separate barrier member is mounted in the envelope and used to shield the electron gun, the member being located intermediate the getter means and the electron gun and serving to prevent material emitted by the getter means and travelling directly towards the gun from reaching the gun.

The provision of such a barrier member is not entirely satisfactory and has a number of disadvantages. Although it is relatively simple to fabricate, its fabrication and securement in the envelope nevertheless adds to the overall time taken to construct the tube and increases the number of components involved. Furthermore, it will be appreciated that the amount of available space within the envelope is minimal and the provision of this additional component takes up valuable space. Besides complicating the assembly of the internal components of the tube, the provision of a barrier member further requires that other components be arranged to allow for its accomodation.

It is an object of the present invention to provide a cathode ray display tube of the above kind including getter means disposed in its envelope but in which the aforementioned disadvantages associated therewith are avoided.

SUMMARY OF THE INVENTION

According to the present invention there is provided a flat cathode ray display tube comprising an envelope having a front wall comprising a flat, optically transparent faceplate carrying a screen and a rear wall opposite the front wall, means for producing an electron beam disposed adjacent the rear wall, the electron beam producing means being arranged to direct an electron beam substantially parallel to the faceplate and over the rear wall of the envelope, a reversing lens which turns the electron beam so that it travels in the opposite direction parallel to the faceplate, a deflector arrangement for deflecting the turned beam towards the screen, and getter means located in the envelope, which is characterised in that the getter means is located laterally of the electron beam producing means adjacent the rear wall of the envelope in at least one recess formed in the rear wall of the envelope and defined at least in part by an elongate rib of the rear wall, the wall of the recess shielding the electron beam producing means directly from the getter means.

By forming the rear wall with a rib to define the getter means containing recess in this manner, an effective barrier for preventing contamination of the electron beam producing means is conveniently provided and the need for an additional component for this purpose is obviated. Moreover, the provision of a rib in this respect has another significant advantage in that it serves also to strengthen the rear wall of the envelope. It will be appreciated that under high vacuum conditions within the envelope, a considerable force acts on the envelope's rear wall. The rib formed therein increases the rear wall's stiffness and inhibits deflection of the rear wall inwardly of the envelope. This enables the possibility of employing thinner material for the rear wall, thus reducing the overall weight of the tube. The rear wall can easily be designed to accomodate the getter means to maintain sufficient free space within the envelope without increasing significantly the depth of the envelope.

The rib may project outwardly of the envelope with the inner surface of the rib itself defining the recess. In a preferred embodiment however, the rib projects inwardly of the envelope and shields the electron beam producing means directly from the getter means. Where the tube includes a further beam deflection electrode arrangement adjacent the electron beam producing means, for example, a line scanning electrode, this further electrode arrangement is preferably also shielded directly from the getter means by said rib.

The getter means may comprise two getters, for example tungsten-titanium getter wires, located in respective recesses formed in the rear wall, each recess being defined at least in part by a respective elongate rib shielding the electron beam producing means, e.g. an electron gun, directly from the getter associated therewith. In this way, even greater mechanical strength is imparted to the rear wall by the provision of two ribs. The two getters may be arranged laterally on either side of the axis of the electron beam producing means with the electron beam producing means disposed in the region intermediate the two ribs.

The rear wall is preferably fabricated as a metal pressing for example of a nickel-iron alloy or mild steel, enabling the ribs to be formed easily and providing adequate mechanical strength.

BRIEF DESCRIPTION OF THE DRAWINGS

A flat cathode ray display tube in accordance with the present invention will now be described, by way of example, with reference to the accompanying drawings, in which.

BRIEF DESCRIPTION OF THE DRAWINGS

Figure 1:
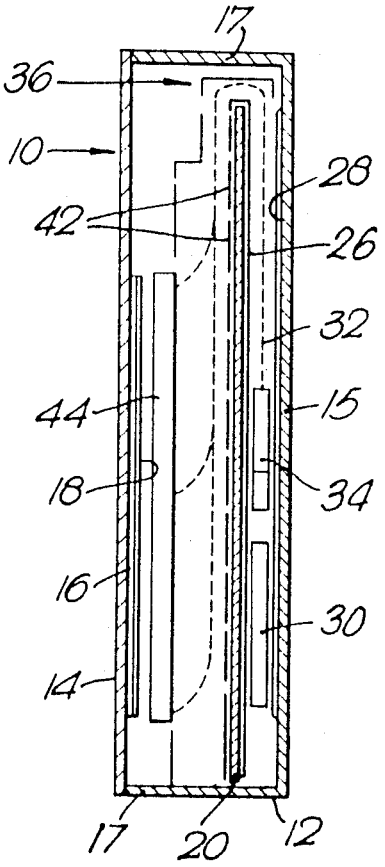
Fig. 1. (Prior Art)
FIG. 1 is a diagrammatic sectional view through the tube showing the main components.

Referring to FIG. 1, the flat display tube 10 comprises a generally rectangular-shaped envelope 12 constituted by a flat, optically transparent glass faceplate 14, a rear wall 15 opposite the faceplate 14 and side walls 17, the side and rear walls being formed of mild steel. On its internal surface, the faceplate 14 carries a phosphor screen 16 including a backing aluminium layer 18 constituting the post deflection screen acceleration electrode.

A partition 20 extending parallel to the faceplate 14 and the rear wall 15 separates the envelope 12 into front and rear parts. An electron gun 30 is provided in the rear part adjacent the rear wall 15 which directs a low-energy electron beam 32 upwardly generally parallel to the rear wall 15 and the partition 20, electrodes 26 and 28 comprising surface areas of the partition 20 and rear wall 15, respectively, defining a field free region. An electrostatic deflection electrode 34 adjacent the electron gun 30 serves to deflect the electron beam 32 produced by the gun in a plane parallel to the faceplate 14 for line scanning.

At the upper end of the envelope 12, there is provided a reversing lens arrangement 36 which is operable to turn the beam 32 through 180° so that it travels in the opposite direction adjacent the other side of the partition 20 in the front part of the envelope. A plurality of laterally elongate, vertically spaced, electrodes 42 are carried on the front side of the partition 20 constituting a frame deflection electrode arrngement. The plurality of electrodes 42 are selectively energisable to deflect the electron beam towards, and scan it over, the input surface of a channel plate electron multiplier 44 extending parallel to, and spaced from, the faceplate 14. The electron beam undergoes current multiplication within the multiplier and upon leaving the multiplier at its opposite output surface is accelerated by the screen electrode 18 onto the phosphor screen 16 to excite the phosphor material.

The display tube is similar to that described in published British Patent Application No. 2101396A corresponding to U.S. patent application Ser. No. 830,388, filed Feb. 14, 1986 (PHB32794) whose disclosure is incorporated herein by reference. For a fuller description of the tube and its operation, reference is invited to this application.

The channel plate electron multiplier may comprise either a laminated dynode electron multiplier, for example as described in British Patent Specification Nos. 1,401,969 and 2,023,332A, or a glass microchannel plate multiplier having a matrix of channels. The fabrication of the latter kind of multiplier is generally well known, further information being available for example from Acta Electronica Volume 14, No. 2, Apr. 1971.

Figure 2:
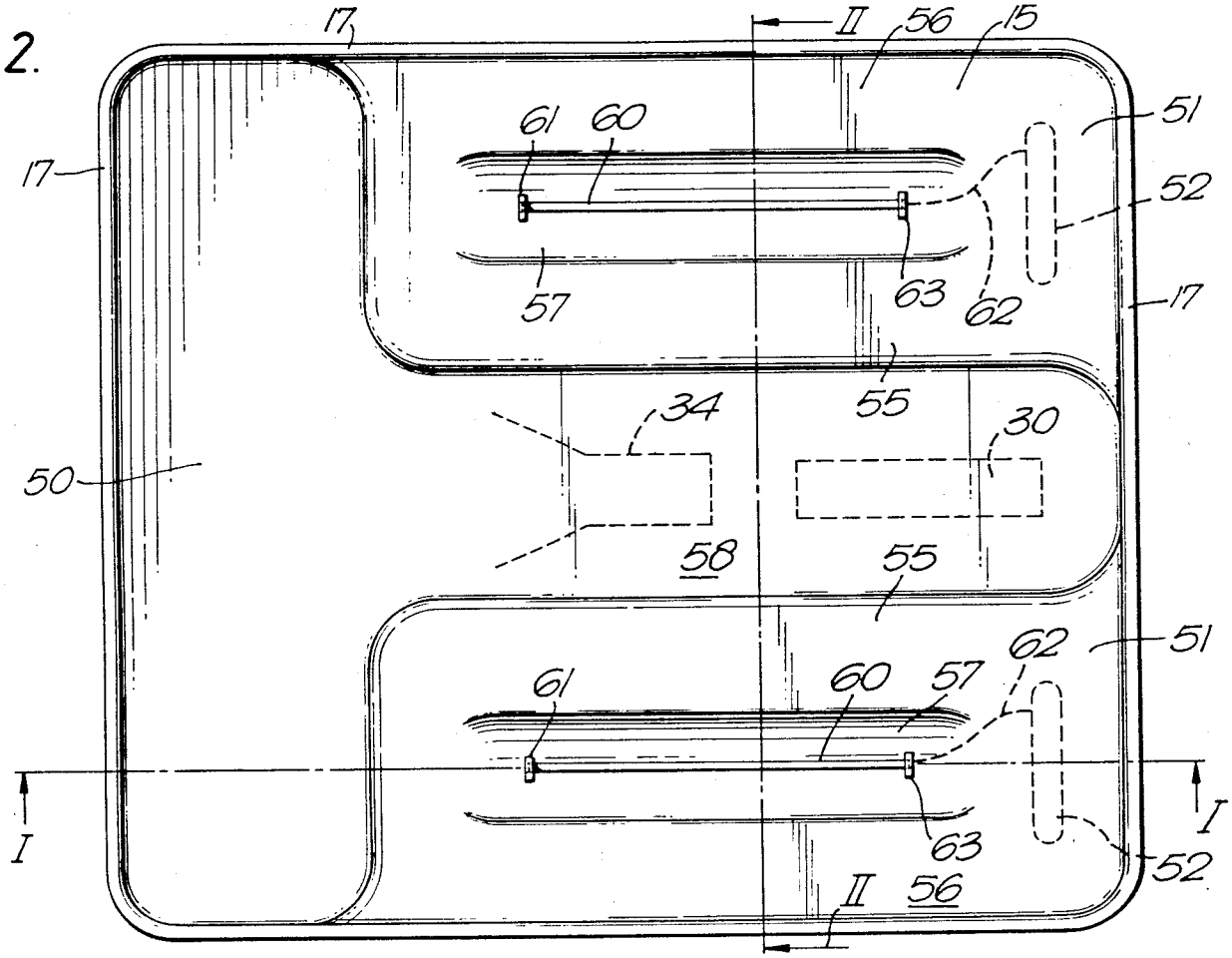
FIG. 2 is a plan view of the rear wall of the envelope of the tube.

Referring now to FIGS. 2 and 3, the rectangular rear wall 15 of the envelope 12 comprises a pressing of a nickel-iron alloy or mild steel of constant wall thickness (between 1.0 and 1.5 mm) and is formed as a generally flat base region 50 with integral upstanding side portions which constitute part of the side walls 17 of the housing. Upon assembly of the tube, this pressing is mated with a further metal alloy or mild steel pressing (not shown) constituting the remainder of the side walls 17 and to which the glass faceplate 14 is sealed, and securely fixed to that further pressing by welding along the continuous outwardly-directed lip at the end of the upstanding side portions.

The rear wall is provided with a pair of symmetrically disposed ledges 51 at its one end in each of which a multipin leadthrough 52 is eventually sealed for establishing electrical connection with internal components of the tube.

Figure 3A:
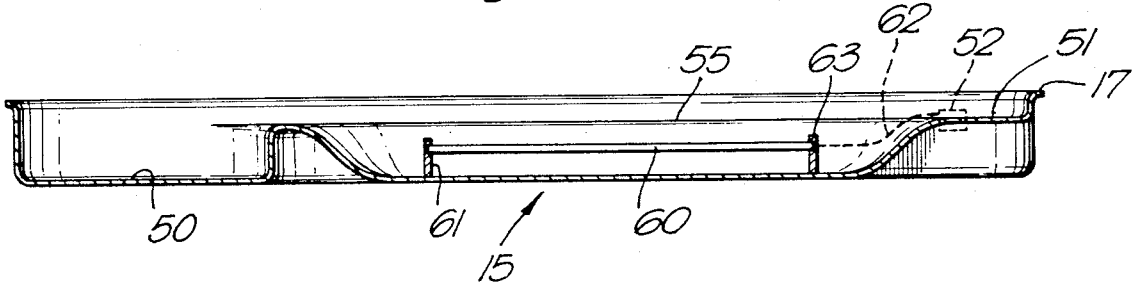
FIGS. 3*a* and 3*b* are cross-sectional views through the rear wall of the envelope along the lines I—I and II—II respectively in FIG. 2.
Figure 3B:
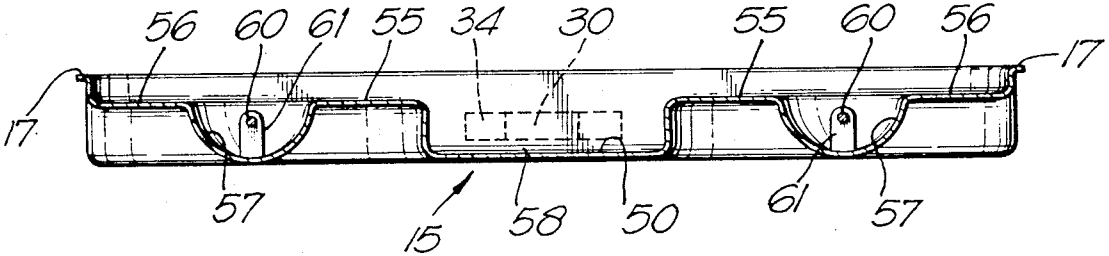

As can be seen clearly from FIG. 3*a* and 3*b*, the base region 50 of rear wall 15 is formed during pressing with two, parallel, flat-topped elongate ribs 55 projecting inwardly and extending lengthwise of the rear wall 15 from the ledges 51 and located symmetrically on either side of a centre line through the rear wall 15. These ribs may alternatively be smoothly curved on top. Together with a respective one of two further elongate ribs 56 formed adjacent the transition between the base region 50 and the upstanding side walls and also extending from the ledges 51, these ribs define respective semi-circular recesses 57 laterally of the recess region 58 bounded by the base 50 intermediate the two ribs 55.

A getter wire 60 comprising a tungsten core and a spiral of tungsten and titanium wound therearound is disposed in each of the recesses 57 and extends therealong above and parallel to the surface of the rear wall 15 with one end connected to an electrically conductive terminal post 61 attached to the rear wall 15 and its other end electrically connected to a supply conductor 62 through an insulative support post 63 to a respective pin of the multi-pin leadthrough 52. The getter wires are positioned within their respective recess such that they are below the innermost level of the ribs 55.

Upon final assembly of the tube, the electron gun 30 and deflection electrode 34 are located by appropriate supports within the region 58 intermediate the ribs 55 (as shown dotted in FIGS. 2 and 3*b*) and adjacent, but spaced from, the surface of the base 50 of the rear wall 15 with their axes overlying and parallel with the centre line of the rear wall. When the laterally spaced getter wires 60 are activated by passing electrical current through them via the parts 61 and leads 62, material evaporated from the wires is prevented from reaching directly the structure of both the electron gun 30 and the deflection electrode 34 by the ribs 55, thus avoiding contamination of the electron gun and deflection electrode.

In addition to acting as a barrier in this way, the ribs serve an additionally important function as structural reinforcement to strengthen the rear wall 15, enabling it to withstand the high vacuum conditions within the envelope without any significant deflection.

We claim:

1. A flat cathode ray display tube comprising an envelope having a front wall comprising a flat, optically transparent faceplate carrying a screen and a rear wall opposite the front wall, means for producing an electron beam disposed adjacent the rear wall, the electron beam producing means being arranged to direct an electron beam substantially parallel to the faceplate and over the rear wall of the envelope, a reversing lens which turns the electron beam so that it travels in the opposite direction parallel to the faceplate, a deflector arrangement for deflecting the turned beam towards the screen, and getter means located in the envelope, characterized in that the getter means is located laterally of the electron beam producing means adjacent the rear wall of the envelope in at least one recess formed in the rear wall of the envelope and defined at least in part by an elongate rib of the rear wall, the wall of the recess shielding the electron beam producing means directly from the getter means.

2. A flat cathode ray display tube according to claim 1, characterised in that the elongate rib projects inwardly of the envelope and shields the electron beam producing means directly from the getter means.

3. A flat cathode ray display tube according to claim 1 , including a further beam deflection electrode arrangement adjacent the electron beam producing means, characterised in that the further beam deflection electrode arrangement is also shielded directly from the getter means by said wall of the recess.

4. A flat cathode ray display tube according to claim 1, characterised in that the getter means comprises two getters each located in a respective said recess formed in the rear wall, each recess being defined at least in part by a respective elongate rib of the rear wall.

5. A flat cathode ray display tube according to claim 4, characterised in that the two getters are arranged laterally on either side of the axis of the electron beam producing means which is disposed in the region intermediate the two ribs.

6. A flat cathode ray display tube according to claim 1, characterised in that the getter means comprises tungsten-titanium wire extending longitudinally of the elongate rib defining each recess.

7. A flat cathode ray display tube according to claim 1, characterised in that the rear wall comprises a metal pressing.

* * * * *